United States Patent [19]

Cook et al.

[11] 4,282,082

[45] Aug. 4, 1981

[54] SLURRY ELECTROWINNING APPARATUS

[75] Inventors: Robert D. Cook, Farmington; Robert C. Emmett, Jr., Salt Lake City; Bruce C. Wojcik, Kearns; Frank A. Baczek, Sandy, all of Utah

[73] Assignee: Envirotech Corporation, Menlo Park, Calif.

[21] Appl. No.: 116,507

[22] Filed: Jan. 29, 1980

[51] Int. Cl.[3] ..... C25D 21/10; C25C 1/12; C25C 7/00; C25C 7/02

[52] U.S. Cl. ..... 204/237; 204/106; 204/269; 204/275; 204/286; 204/289

[58] Field of Search ..... 204/106, 105 R, 275–278, 204/286, 288, 237, 293, 292, 242, 289, 280, 269

[56] References Cited

U.S. PATENT DOCUMENTS

| | | | |
|---|---|---|---|
| 1,449,462 | 3/1923 | Van Arsdale | 204/289 X |
| 1,697,771 | 1/1929 | Laist et al. | 204/293 X |
| 2,604,441 | 7/1952 | Cushing | 204/280 X |
| 3,579,431 | 5/1971 | Jasberg | 204/275 |
| 3,682,809 | 8/1972 | Marquardson et al. | 204/275 |
| 4,061,559 | 12/1977 | Kitamura et al. | 204/106 |
| 4,129,494 | 12/1978 | Norman | 204/275 X |
| 4,139,429 | 2/1979 | Steward et al. | 204/105 R |

*Primary Examiner*—Donald R. Valentine
*Attorney, Agent, or Firm*—Robert E. Krebs; T. J. McNaughton

[57] ABSTRACT

A slurry electrowinning apparatus includes a tank (10) in which are mounted alternating, spaced-apart anode (18) and cathode (20) electrodes. An inlet opening (60) is formed in a side of the tank (10) for introducing a copper-bearing electrolyte to the tank (10). An overflow opening (76) is also formed in a side of the tank (10) such that a solution level (62) is maintained in the tank (10) which is above the inlet opening (60). Baffles (64) are mounted within the tank (10) for evenly distributing the slurry within the tank (10) between the anodes (18) and cathodes (20). Both the anodes (18) and the cathodes (20) are supported within the tank (10) by electrode guides (22) such that a high pressure contact between the electrodes (18, 20) and the main electrical bussing (78) is provided.

13 Claims, 11 Drawing Figures

SLURRY ELECTROWINNING APPARATUS

BACKGROUND OF THE INVENTION

1. Field of the Invention

The present invention relates to an apparatus for continuously electrowinning copper from a slurry comprising copper-bearing solids and an electrolyte.

2. State of the Art

Due to environmental problems inherent in conventional copper recovery techniques such as smelting, utilization of electrowinning techniques for recovering copper has been receiving increased attention.

The majority of electrowinning techniques recover copper from a clear, copper-bearing electrolyte. That is, copper-bearing solids are dissolved in an electrolyte and the resulting solution is electrolyzed in a tank having anode and cathode electrodes which are immersed in the solution. Positively charged copper ions in the electrolyte solution migrate to the cathode and deposit upon the cathode as elemental copper when an electric current is passed through the solution. For a typical sulfate-based electrolyte solution, copper is deposited at the cathode and oxygen gas is evolved at the anode.

One type of copper electrowinning device utilizes a diaphragm to divide the device into separate anode and cathode compartments. Such diaphragm devices are utilized when the electrolyte contains an oxidizable component which is oxidized at the anode. The oxidizable component is retained in an anolyte within the anode compartment to isolate it from the cathode where it could, in turn, be reduced. When the oxidizable component is oxidized in the anolyte of a diaphragm cell, it is normally used subsequently to oxidize copper-bearing feed material to replenish copper in solution for further electrowinning.

In some cases, a solid copper-bearing feed material is mixed with electrolyte and the slurry is fed directly to the anode compartment of the diaphragm cell. In this case, oxidation of the oxidizable electrolyte component and of the copper mineral takes place simultaneously.

A typical slurry electrowinning device includes a tank which contains a number of alternating, spaced-apart cathode and anode electrodes. Crushed copper-bearing feed material is slurried with a suitable electrolyte and fed into the tank. A maximum electrolyte level is maintained in the tank by an overflow outlet. The overflowing electrolyte is continuously recycled to the feed inlet of the tank to be slurried with further crushed feed material. Either mechanical mixers or gas spargers are utilized to agitate the slurry to ensure uniform circulation of the slurry across the faces of the cathode and anode electrodes. Alternatively, the electrodes themselves are oscillated to provide the proper agitation. Current is passed through the electrolyte with the result that copper deposits on the cathodes. Periodically, the cathodes are removed from the tank and the deposited copper is harvested.

Conventional slurry electrowinning devices are typically plagued by a number of problems. First, the feed inlet to the electrolysis tank is often above the solution level in the tank. The fall of the feed solution into the tank entrains air and causes a heavy froth to form at the top of the tank. This froth often overflows from the top of the tank, introducing a highly acidic liquid to the nearby work environment and, at the same time, depleting the electrolyte solution of valuable solids. Second, attempts to eliminate the above problem by placing a hood or cover over the tank have proven impractical in commercial operations. To remove copper-laden cathodes from the covered tank, it is necessary to stop circulation in the tank, disconnect the feed piping and remove the cover which is dripping with acidic solution. With the tank's circulation system shut down, solids settle to the bottom of the tank, compact and plug the unit. Third, past efforts to eliminate the above problems by utilizing a feed inlet in the side of the tank have been largely unsuccessful because the side feed has resulted in uneven flow distribution within the tank, the flow entering the tank at high velocity and at right angles to the desired flow between the anodes and cathodes.

SUMMARY OF THE INVENTION

The present invention provides a slurry electrowinning apparatus which eliminates the above-mentioned problems. The apparatus includes a tank in which are mounted alternating, spaced-apart anode and cathode electrodes. An inlet opening is formed in a side of the tank for introducing a copper-bearing electrolyte to the tank. An overflow opening is also formed in a side of the tank such that a solution level is maintained in the tank which is above the inlet opening. In this way, the slurry is introduced to the tank below the solution level and foaming problems associated with prior art devices are eliminated. Baffle plates are mounted within the tank for evenly distributing the slurry within the tank between the anodes and cathodes. Both the anodes and cathodes are supported within the tank by electrode guides such that a high pressure contact between the electrodes and the main electrical bussing is provided.

DESCRIPTION OF THE PREFERRED EMBODIMENT

Figure 1:
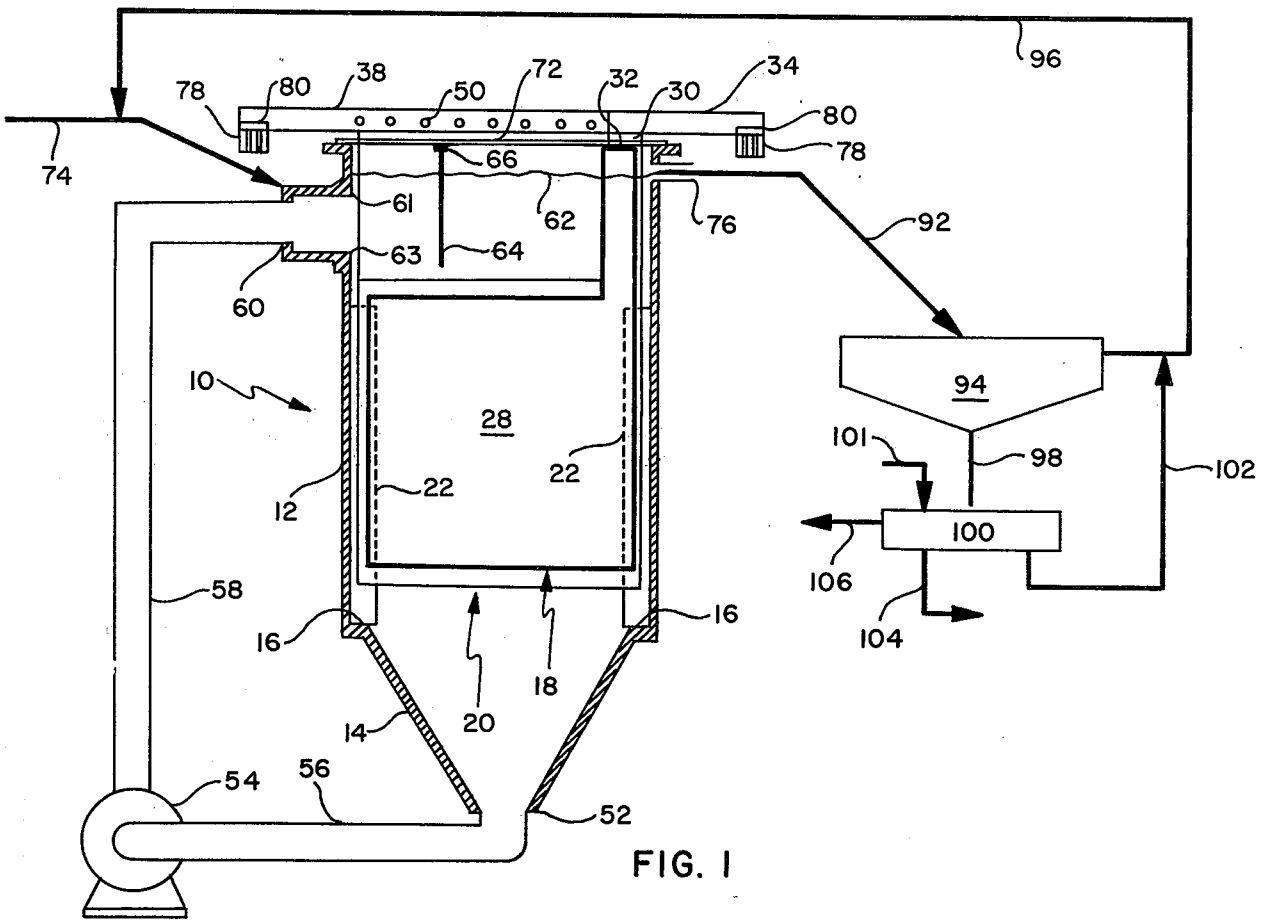

The electrowinning apparatus shown in FIG. 1 includes a tank 10 having a generally rectangular upper section 12 and a conical or V-shaped lower section 14. The sides of the V-shaped lower section 14 slope at an angle of at least about 45° and preferably at an angle of about 60° to prevent deposition of solids on the inner surfaces of the lower section 14. A relatively narrow, horizontal ledge 16 is formed on opposite sides of the tank 10 at or near the transition between the upper section 12 and the lower section 14.

A plurality of alternating, spaced-apart anode 18 and cathode 20 electrode plates are mounted within the tank 10. The anode 18 and cathode 20 electrodes are held in place within the tank by electrode guides 22 (shown in phantom lines in FIG. 1) which are located at opposite sides of the tank 10 and, in the illustrated embodiment, are mounted on the transition ledges 16 to extend the length of the tank 10.

Figure 2:
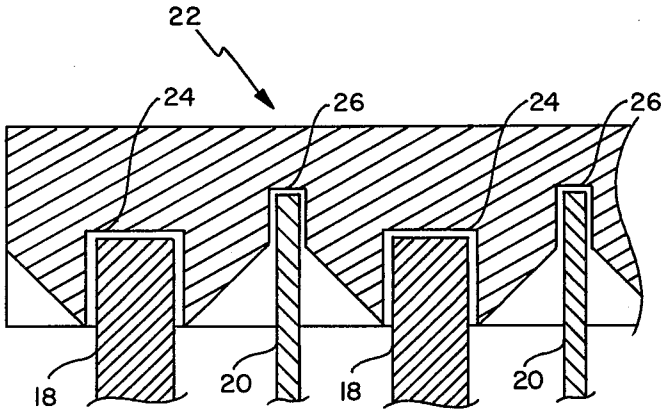

As shown in FIG. 2, the guides 22 not only hold the anodes 18 and cathodes 20 in a generally vertical spaced-apart position across the width of the tank 10 by means of anode guide slots 24 and cathode guide slots 26, respectively, but also provide masking of the anodes 18 from the cathodes 20 to prevent copper from plating on the cathodes 20 to the edges of the cathode guide slots 26. This is accomplished by utilizing cathodes 20 which are wider than the anodes 18 and by utilizing cathode guide slots 26 which are formed in a generally V-notch shape as shown in FIG. 2 to extend deeper into the width of the guide 22 than do the anode guide slots 24. The guide slots are spaced-apart to provide a spacing of about 0.75 to 1.00 inches between the adjacent faces of the anodes 18 and the cathodes 20. A 0.75 inch spacing between the adjacent electrode faces is preferred.

The guide slots 24, 26 also support the electrodes 18, 20 horizontally to provide a high contact pressure at the bussing contacts where the anodes 18 and cathodes 20 make electrical contact with the main electrical bussing for the apparatus. This is accomplished by varying the length of the guide slots 24, 26 for a selected electrode on opposite sides of the tank 10 such that the guide slots provide horizontal support for the electrode on only one side of the tank 10. That is, for a selected electrode, the guide slot on the side of tank 10 opposite the bussing contact for the electrode is of a length such that the slot provides support for the electrode at the proper height within the tank 10. For the same electrode, the guide slot on the opposite side of the tank 10, i.e. the side corresponding to the bussing contact, is longer than the electrode so that it does not support the electrode. Rather, the electrode is supported on the bussing contact side of the tank 10 only by the bussing contact. Thus, the weight of the electrode is applied at the bussing contact to provide a high pressure contact.

Figure 3:
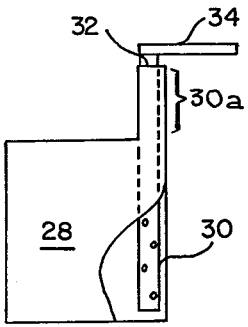

Referring to FIG. 3, each anode 18 comprises a lead plate 28 which is about 0.625 inches thick. Preferably, the lead used is an alloy containing about 91.6% lead, about 8% antimony and about 0.4% arsenic. This composition holds up well to the electrolyte solution and is rigid without being brittle. A copper bar 30 of a size suitable to carry the required current is cast into the lead plate 28 and extends up from one corner. The extension portion 30*a* of the bar 30 is covered with lead to a point 32 just below where a horizontal bussing contact 34 is attached. The extension 30*a* must be covered with an electrical insulating material to mask it electrically from the adjacent cathode 20. Masking in this manner prevents plating on the cathode 20 opposite the extension 30*a*. Preferably, heat shrink tubing is applied to the extension.

Figure 5:
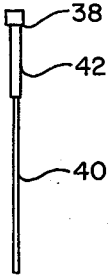
Figure 4:
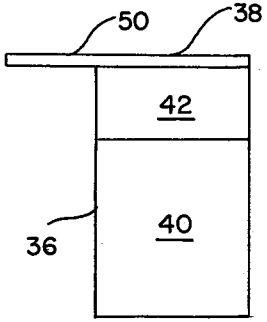

As shown in FIGS. 4–5, each cathode 20 comprises a sheet 36 of titanium with a horizontal electrical contact bar 38 mounted at its top. Because of its strength and rigidity, grade 2 titanium in thin sheets is a preferred material for the cathode 20. Grade 2 titanium is also a much better conductor than other more highly alloyed grades. Each cathode 20 consists of two parts: a lower part 40 where plating takes place and an upper part 42 where no plating occurs but which must conduct current from the lower part 40 to the electrical contact bar 38. The lower part 40 of the cathode 20 is thus made as thin as possible to reduce material costs. The upper part 42 is designed to dissipate as little electrical power as possible. The lower part 40 needs only to be thick enough to resist warping and mechanical damage from handling (The cathodes 20 must maintain an overall flatness of 0.125 inches or better). The thickness of the lower part 40 of the cathode is between about 0.125 and 0.187 inches, a 0.187 inch thickness being preferred.

To minimize electrical power loss in the upper part 42 of the cathode 20, the cross sectional area of the titanium in this area is increased. Titanium about 0.375 inches thick in the upper part 42 of the cathode 20 provides the maximum power savings. Thus, the preferred cathodes 20 have upper parts about 0.375 inches thick and lower parts which are considerably thinner, about 0.187 inches thick.

Figure 6:
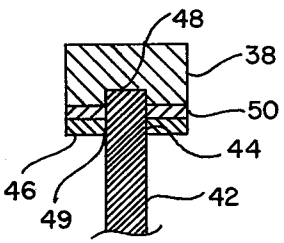

As stated above, an electrical contact bar 38 is mounted at the top of each cathode 20. The contact bar 38 is copper since it is out of the electrolyte solution. As shown in FIG. 6, a horizontal slot 44 is milled along the lower edge 46 of the contact bar 38 to accept the top 48 of the upper part 42 of the titanium plate 36. The joint 49 between the upper part 46 of the plate and the contact bar 38 is flame sprayed with copper to produce a good electrical contact. The upper part 42 of the titanium plate 36 and the copper contact bar 38 are joined by stainless steel bolts or copper rivets 50.

Referring again to FIG. 1, formed at the bottom of the lower section 14 of the tank 10 is an outlet opening 52 which communicates with the inlet of an electrolyte slurry recirculation pump 54, preferably an axial flow pump, via discharge pipe 56. The outlet of the recirculation pump 54 is connected via pipe 58 to a tank inlet opening 60 formed in a side of the tank 10. The recirculation pump 54 continuously recirculates electrolyte slurry from the outlet opening 52 to the inlet opening 60 to maintain solids suspension and slurry agitation within the tank 10.

Figure 7:
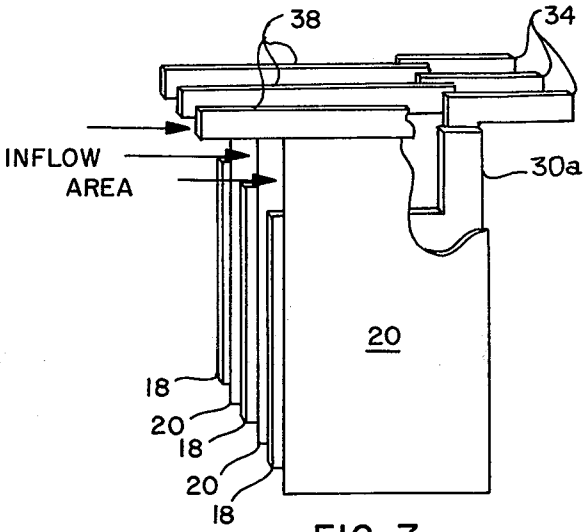

The inlet opening 60 is formed in the side of the tank 10 such that the electrolyte slurry is introduced to the tank 10 below the solution level in the tank 10 to minimize agitation and air intrainment at the surface of the solution. Preferably, the top edge 61 of the opening 60 is located about four inches below the electrolyte solution level 62 in the tank 10. The bottom edge 63 of the inlet opening 60 is about 6 inches above the upper edge of the anodes 18. As shown in FIG. 7, it is preferred that the inlet opening 60 be located on the side of the tank 10 which is opposite the anode electrical contacts 34 so that the extensions 30*a* do not block the inflow area.

Referring again to FIG. 1, adjustable baffles 64 are mounted within the tank 10 to create a generally even, downwardly directed velocity profile of electrolyte slurry across the width of the tank 10. Preferably, the velocity is about 45 ft./min.

Without the baffles 64, the inlet velocity of the electrolyte slurry introduced via inlet opening 60 produces a generally circular flow pattern within the tank 10. That is, a strong upflow pattern is established on the inlet side of the tank 10, a strong downward flow pattern is established on the side opposite the inlet opening, while the middle of the tank 10 remains relatively stagnant.

To correct this, the baffles 64 are mounted within the tank 10 in front of the inlet opening 60 perpendicular to the inlet flow. Thus, the baffles 64 force a portion of the inlet flow down the inlet side of the tank 10 and a portion down the middle of the tank 10 to create a generally even downward flow distribution across the width of the tank.

Preferably, baffles 64 are positioned about 4 to 6 inches in front of the inlet opening 60, above the top edge of anodes 18 and between adjacent cathodes 20. The baffles 64 extend from above the solution level 62 in the tank 10 to about 3 inches above the anode 18 and are about 13 inches long. The plates 64 are made of 16 gauge titanium and have a stiffening rib welded to the back to provide additional strength. The top of the baffle 64 is attached to a stainless steel rod 66 which is held by an adjustable bracket 72 mounted on the top of the tank 10. The bracket 72 allows the position of the baffle plate 64 and its depth in the solution to be adjusted.

According to an alternative embodiment, the baffles are individually attached to the tank wall making it unnecessary to remove them when removing cathodes 20 from the tank 10. With this alternative embodiment, the only time the baffles 64 need be removed from the tank 10 is when it is necessary to remove the anodes 18. According to another alternative embodiment, the baffles 64 described above are split in half, the halves being attached to the faces of adjacent cathodes. This later embodiment, however, results in a fragile cathode susceptible to damage when removed from the tank 10.

A feed slurry of copper-bearing material is introduced to the tank 10 via line 74 to replace copper that has deposited on the cathodes 20. To compensate for this addition of liquid to the tank 10, an overflow opening 76 is formed on a side of the tank 10 to maintain a constant liquid level in the tank 10. In the illustrated embodiment, the overflow opening 76 is formed on the side of the tank 10 opposite the inlet opening 60. The overflow opening 76 is positioned to maintain the solution level 62 in the tank 10 about 4 inches above the top 61 of the inlet opening 60. The overflow opening 76 also maintains the solution level 62 about 4 inches below the open top of the tank 10 to provide adequate free board.

Bussing contacts 34 and 38 for the anodes 18 and cathodes 20, respectively, provide an electrical connection between the anodes 18 and cathodes 20 and the main electrical bussing system 78 located outside of the tank 10. To further increase high contact pressure between the bussing contacts and the main bussing system, a knife edge contact 80 is typically utilized on each bussing contact 34 and 38. While a knife edge contact provides high contact pressure, its contact area is relatively small. Conversely, utilizing a large contact area produces a low contact pressure. A toggle clamp may be used to force the buss firmly into the contact.

Generally one square inch of copper conductor cross-sectional area is required for every 1000 amps to be conducted. It is preferred to keep the amperage below 1000 amps per square inch if possible. The main bussing contacts 78 utilized in the illustrated embodiment have a preferred cross-section area of $0.5\times12$ or 6 square inches. Thus, each buss bar 78 can carry about 6000 amps. Thus, for an electrowinning apparatus operating at 24,000 amps, four buss bars would be required. It is preferred that five be used.

Figure 9:
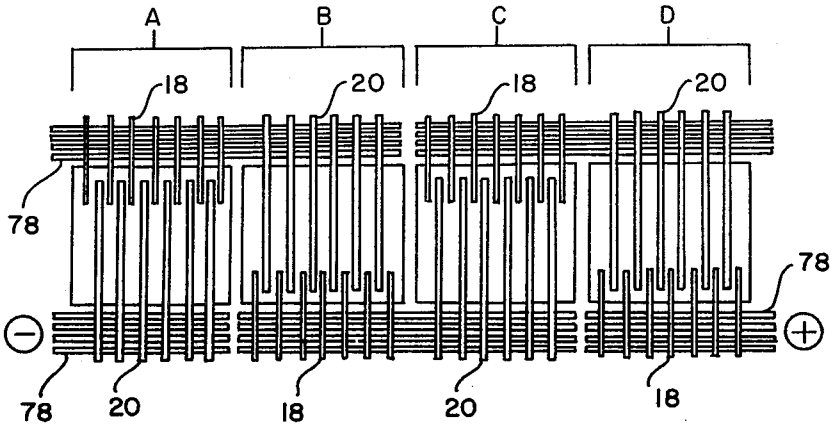
Figure 8:
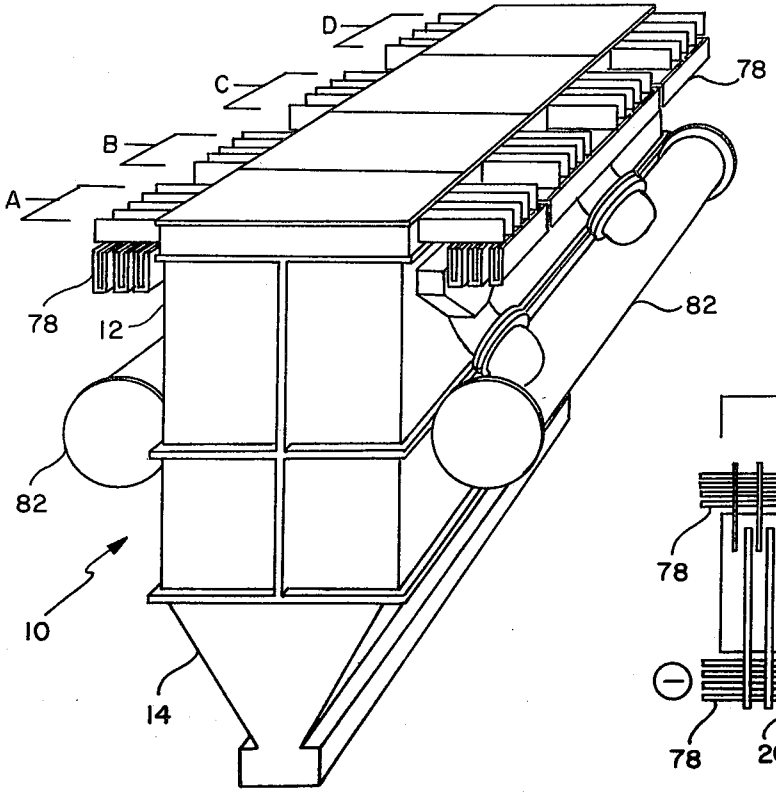

A preferred embodiment of the apparatus of the present invention shown in FIGS. 8 and 9 includes a tank 10 which is divided into a plurality of electrode cells. Four such cells, A, B, C, and D are shown in FIGS. 8 and 9. As shown in FIG. 9, each cell contains parallel-bussed anodes 18 and cathodes 20. The four cells are bussed in series. The purpose of this arrangement is to reduce the amount of bussing material required to supply the current density of 90–125 amps per square foot to the cathode surface area.

The embodiment shown in FIG. 8 includes a circulation inlet manifold 82 for delivering electrolyte slurry solution to the inlet opening 60 of each cell. Since the electrical bussing contacts 34 for the anodes 18 are on opposite sides of the tank 10 for adjacent cells, a manifold 82 is provided on each side of the tank 10.

Figure 10:
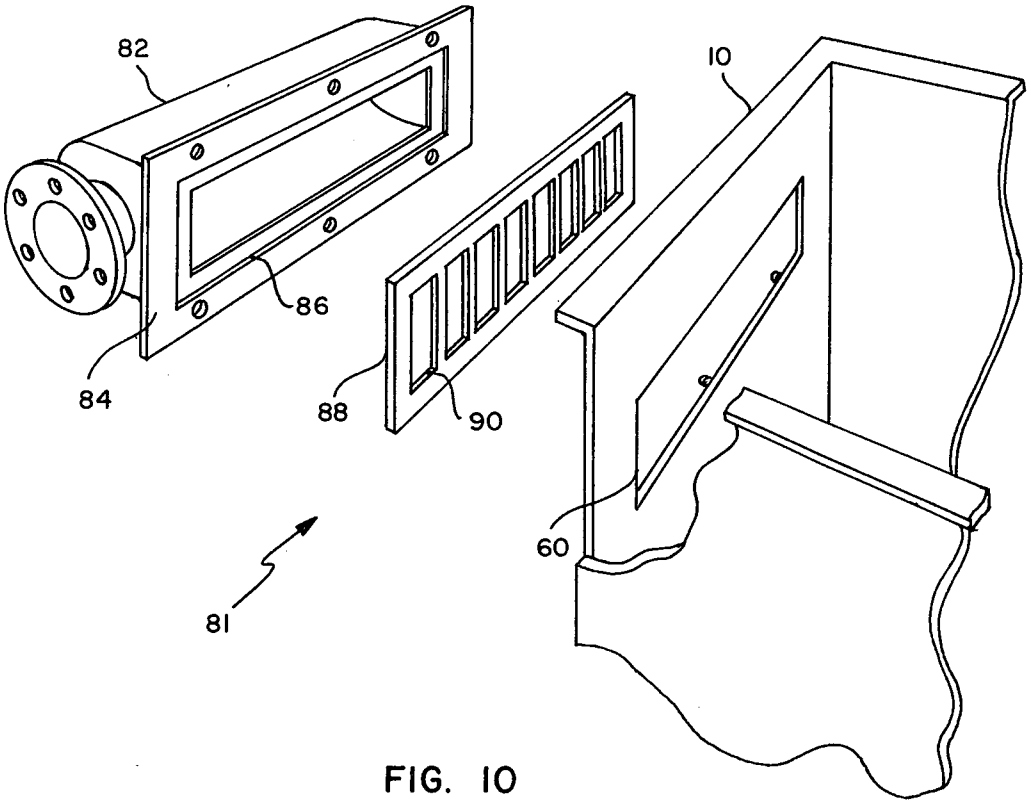

FIG. 10 shows a preferred inlet assembly 81 for the tank 10. Attached to the inlet manifold 82 is a flange 84 which is removably attached to the side of the tank 10 by, for example, bolts such that an opening 86 formed in the manifold 82 corresponds to the inlet opening 60 in the tank 10. Orifice plate 88, having a plurality of feed openings 90 formed therein, is located between flange 84 and tank 10 when the manifold 82 is attached to the tank 10. Feed openings 90 are properly sized so that electrolyte slurry solution can be introduced to the tank 10 with the desired velocity and at a flow rate which is the same for all openings 90. The openings 90 are further positioned to introduce solution between the cathodes 20 located in a particular cell. Alternatively, the orifice plate 88 can be eliminated and the openings 90 can be formed either directly in the side of the tank 10 or as part of the manifold 82.

The velocity of the copper-bearing slurry circulating between the anodes 18 and cathodes 20 in a particular cell should be about 45 feet per minute. In a tank having a width of about 36 inches, and with an electrode spacing of about 0.75 inches, each space between a cathode 20 and an anode 18 requires about 63 gallons per minute. Each feed opening 90 provides slurry flow to two such chambers. Thus, each feed opening 90 must accommodate about 126 gallons per minute. Because of space limitations, the maximum practical size for the feed openings 90 is about $1.5\times6$ inches. This results in an inlet velocity of about 4.5 feet per second.

The operation of the apparatus described above will now be discussed.

As shown in FIG. 1, a copper-bearing feed material is mixed via line 74 with electrolyte slurry recirculated by pump 54 and is introduced to the tank 10 via inlet opening 60. The electrolyte comprises an aqueous solution of copper sulfate, iron sulfate, sulfuric acid and small amounts of chloride.

During normal operation, the concentration of the electrolyte components in the tank 10 will remain constant. However, non-copper elements such as iron may be dissolved from the feed material along with the copper under conditions of ferric oxidation. When this occurs, a bleed stream is required in order to maintain a low impurity level within the tank 10. The addition of make-up electrolyte with the feed slurry consists of adding water, sulfuric acid, and ferrous sulfate solution. Dissolved copper required in the make-up is provided by controlling operation so that copper is leached at a rate faster than it is deposited. Thus, as make-up solution is added, the copper concentration is diluted to the correct concentration.

A continuous overflow of slurry-containing electrolyte and leached copper-bearing solids is directed via overflow opening 76 and line 92 to a thickener 94 for separation of the electrolyte from the leached solids. The electrolyte is then returned to the tank 10 via line 96 to be mixed with fresh copper-bearing solids. The thickener underflow, which contains leached solids and entrained electrolyte, is directed via line 98 to a filter 100 for removal of the entrained electrolyte. The removed entrained electrolyte is combined via line 102 with the clarified electrolyte, i.e., the thickener overflow, and returned to the tank 10. The filtered leached solids are washed with water introduced via line 101 for removal of any residual electrolyte to produce a very weak electrolyte stream. Because the weak electrolyte would dilute the electrolyte in tank 10 if returned to tank 10, it is kept separate and directed via line 104 to a copper recovery step. The filtered and washed solids are directed via line 106 to further processing.

Current density is maintained in the range of 90–125 amps per square foot, depending upon the feed material. These high current densities allow cathode current efficiencies of 65–75 percent to be maintained at levels of 1.5–3 gpl of ferric iron in the electrolyte. Lowering the current density causes a proportional drop in the current efficiencies.

Figure 11:
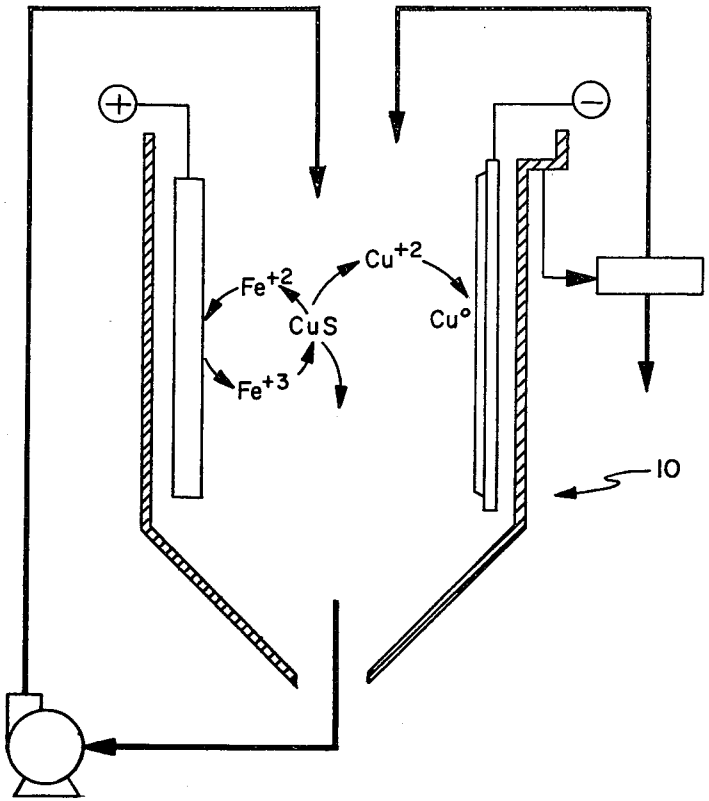

Reactions within the tank 10 include simultaneous leaching and electrowinning of copper values from the electrolyte slurry solution. FIG. 11 schematically illustrates this process for a covellite feed. With iron present in the electrolyte solution, ferric iron is generated at the anode instead of oxygen. Introduction of copper-bearing solids directly into the tank 10 makes use of this anode generated oxidant ($Fe^{+3}$), allowing the simultaneous dissolution of copper as well as cathodic reduction of the leached copper. Ferrous iron generated as a result of leaching of the copper-bearing solids is then reoxidized at the anode.

The chemistry of ferric iron leaching taking place within the tank 10 for chalcocite, covellite, cement copper and chalcopyrite is represented by Equations 1 through 4, respectively.

| | |
|---|---|
| $Cu_2S + 4Fe^{+3} \rightarrow 2Cu^{+2} + 4Fe^{+2} + S^{\circ}$ | (EQ 1) |
| $CuS + 2Fe^{+3} \rightarrow Cu^{+2} + 2Fe^{+2} + S^{\circ}$ | (EQ 2) |
| $Cu^{\circ} + 2Fe^{+3} \rightarrow Cu^{+2} + 2Fe^{+2}$ | (EQ 3) |
| $CuFeS_2 + 4Fe^{+3} \rightarrow Cu^{+2} + 5Fe^{+2} + 25^{\circ}$ | (EQ 4) |

Some direct oxidation due to contact of copper-bearing solids with the anode may also take place. For chalcocite, this is represented by Equation 5.

$$Cu_2S \rightarrow 2Cu^{+2} + S^{\circ} + 2e^{-} \quad \text{(EQ 5)}$$

Copper is leached from the solids and deposited at a rate such that a constant dissolved copper concentration is maintained in the electrolyte. Copper is harvested from the apparatus at approximately 48-hour intervals.

Generation of ferric iron is the dominant anodic reaction and is represented by Equation 6.

$$Fe^{+2} \rightarrow Fe+^{3} + e^{-} \quad \text{(EQ 6)}$$

This reaction is a contributor to lowering cell voltages to the range of conventional electrowinning devices although current densities are 5 times that of conventional operations. Numerous reactions, represented by Equations 7 through 9 below, are possible at the cathode with copper deposition being predominant.

| | |
|---|---|
| $Cu^{+2} + 2e^{-} \rightarrow Cu^{\circ}$ | (EQ 7) |
| $Fe^{+3} + e^{-} \rightarrow Fe^{+2}$ | (EQ 8) |
| $2Fe^{+3} + Cu^{\circ} \rightarrow 2Fe^{+2} + Cu^{+2}$ | (EQ 9) |

A limited reaction of ferric iron directly with the copper deposit, as shown by Eq. 9, is desired. This reaction makes slurry electrowinning at high current densities possible. Dendrites that might form during copper deposition create a high turbulence area that promotes rapid ferric attack of the dendrites and, thus, a smooth copper deposit is maintained. The uniform, non-dendritic deposit is less prone to trap suspended soids present in the electrolyte. The loss of current efficiency, due to this reaction, is offset by the high current densities used. That is, copper is deposited faster than iron etches it away.

The concentration of ferric iron in the electrolyte is maintained between about 1.5–3 gpl. As described above, ferric iron is continuously generated at the anode. If the ferric concentration is allowed to increase above 3 gpl., attack of the copper deposit according to Eq. 9 becomes predominant and current efficiencies drop. The ferric concentration is held at the proper level by controlling the rate of feed material introduced to the tank 10.

Increasing the feed rate provides more leachable solids to the electrolyte, allowing ferric iron to attack the solids, rather than the cathodes deposit. If the ferric iron concentration drops below the acceptable level, the feed rate is decreased to allow ferric iron to increase. Total dissolved iron concentrations below 25 gpl seem to cause a drop in anode efficiencies.

The ferric to ferrous ratio in the electrolyte, as well as the ferric ion concentration, is monitored by the use of redox potential (EMF) measurements. These measurements, which are continuous during operation, are essential in controlling the leaching and electrowinning operations. The best cathode qualities and leach rates are obtained when the EMF is in the range of +385 to +400 millivolts. Operation below +385 millivolts results in powder and dendritic formations that entrain solids. Operations above +400 millivolts cause poor cathode current efficiencies and significant redissolution of the cathode.

The sulfuric acid content of the electrolyte is generally held between about 100 and 120 gpl. If the acid concentration is raised above 120 gpl to about 140 gpl, a softer cathode copper is usually produced and at higher current efficiency with more probability of dendrite growth. A lower acid content (75 gpl) hardens the copper and reduces current efficiencies.

The dissolved copper concentration of the electrolyte is between about 10 to 40 gpl, preferably about 30 to 40 gpl. Good quality cathode deposits are achieved with copper concentrations as low as 10 to 15 gpl, but these concentrations tend to promote the growth of a powder deposit. Copper concentrations above 40 gpl cause voltage increases.

The use of chloride in the electrolyte is extremely beneficial. Chloride concentrations of about 30 gpl alleviate the crystalline structure of the cathode. Chloride additions up to 240 gpl increases leach rates and current efficiencies in proportion to the amount added. Chlorides in excess of 240 gpl have little or no benefit, but instead have detrimental effects on chalcocyte electrowinning. In the case of leaching chalcopyrite, concentrations of up to 600 ppm gpl chloride are beneficial. Thus, the chloride concentration is essentially determined by the type of feed material being processed.

Glue (Swift Protein) is added continuously during operation in amounts equal to or less than dosages used in conventional tank houses (approximately 0.1 pounds per ton copper). The glue provides a beneficial hardening and leveling effect to the cathode copper.

The concentration of solids in the electrolyte slurry is normally kept in the range of 7 to 10% with normal concentrates in the range of 50–60%–200 mesh. Selection of the best value for a given process feed material depends upon the slime content of the feed. Slimes are usually smaller than 3 microns. The allowable limitation for slime buildup is about 1% by weight of the slurry. If the slime content is greater than 1%, leached copper in the electrolyte is barred from depositing at the cathode. This causes starvation of the copper ion and powdered copper reacts with elemental sulphur to form copper sulphite. This reaction brings copper deposition at the cathode to a halt. Thus, in processing feed that has a high slime content, slurry density is kept low, approximately 3% by weight, and the return electrolyte is polished with a filter to remove any slimes which did not settle out in the cell overflow thickener as discussed above.

Operating temperature is normally maintained at 80° centigrade. This is beneficial to the leach rate and also lowers the cell voltage due to increase conductivity and lower electrolyte viscosity. To remove excess heat generated at the high operating current densities, a cooling loop is included in the cell circuit. Recovered heat can be used to heat various unit operations throughout the process.

As stated above, a downward slurry flow velocity of approximately 40 to 45 feet per minute between the anodes and cathodes is optimum for electrowinning at about 90 to 125 amps per square foot. A higher flow velocity causes lower current efficiencies due to increased ferric etching of the cathode deposit. Lower flow velocities result in a boundary layer at the cathode which becomes depleted of copper and thus tends to promote powder deposition. The baffle arrangement described above is used to evenly distribute the electrolyte within the cell.

We claim:

1. An electrowinning apparatus for recovering copper from a slurry comprising copper-bearing solids and an electrolyte, the apparatus comprising:

a. a tank for containing said slurry, said tank having alternating spaced-apart anodes and cathodes mounted therein;

b. an inlet opening formed in a side of said tank, at a level above the top of said anodes and cathodes and adapted to be below the upper level of the slurry, for introducing said slurry into said tank;

c. an overflow opening formed in a side of said tank for maintaining a slurry level within said tank which is above said inlet opening such that said slurry is introduced to said tank below said level;

d. a tank bottom including means to recirculate a portion of said slurry from said tank bottom to the inlet opening; and e. electrical bussing in contact with said anodes and cathodes for providing electric current to same such that when current is passed therebetween through said slurry, copper deposits upon said cathodes.

2. The apparatus of claim 1 wherein said inlet opening and said overflow opening are formed in opposite sides of said tank and said bussing is at an end of said anodes and cathodes opposite the inlet opening.

3. An apparatus according to claim 1 further including baffle means mounted within said tank in front of said inlet opening for creating a generally even, downwardly directed velocity profile of said slurry across the width of said tank.

4. The apparatus of claim 3 wherein said slurry is introduced to said tank at a velocity of about 4.5 feet per second.

5. The apparatus of claim 4 wherein said downward slurry velocity within said tank is about 45 ft./min.

6. The apparatus of claim 1 wherein said tank bottom includes a v-shaped lower section to prevent deposition of solids on the tank bottom and wherein said means to recirculate includes an outlet opening at the bottom of the v-shaped section and a pump for flowing slurry to said inlet opening.

7. An electrowinning apparatus for recovering copper from a slurry comprising copper-bearing solids and an electrolyte, the apparatus comprising:

a. a rectangular tank for containing said slurry, said tank having alternating spaced-apart cathodes and anodes mounted therein;

b. an inlet opening formed in one wall of the tank at a level above the top edges of said cathodes and anodes and adapted to be below the upper level of the slurry;

c. an overflow outlet on a wall opposite the inlet opening for maintaining a slurry level above said inlet opening, said cathodes and anodes being oriented parallely to each other and perpendicular to the walls containing said inlet opening and overflow outlet;

d. guide means mounted within said tank on such opposite side walls of said tank to extend the length of said tank, said guide means having alternating spaced-apart anode guide slots and cathode guide slots formed therein for holding said anodes and cathodes, respectively, in a generally vertical spaced-apart relationship across the width of said tank; and e. electrical bussing in contact with said anodes and cathodes for providing electric current to same such that when current is passed therebetween through said slurry, copper deposits upon said cathodes.

8. The electrowinning apparatus of claim 7 wherein said cathodes are wider than said anodes and said cathode guide slots are formed in a generally v-notch shape to extend deeper into the width of said guide means than do said anode guide slots.

9. The electrowinning apparatus of claim 8 wherein, for a selected anode or cathode, said electrode guide slots vary in length on opposite sides of said tank, the guide slot on the side of said tank opposite said bussing contact being of a length such that it supports said selected anode or cathode, the guide slot on the side of said tank corresponding to said bussing contact being of a length such that it does not support said selected anode or cathode so that said selected anode or cathode is supported on said bussing contact side of said tank only by said bussing contact such that the weight of said selected anode or cathode is applied at said bussing contact to provide a high pressure contact.

10. The apparatus of claim 9 wherein said inlet opening is formed in the side of said tank opposite said anode bussing contacts.

11. An electrowinning apparatus for recovering copper from a slurry solution comprising copper-bearing solids and an electrolyte, the apparatus comprising:

a. a tank for containing said slurry solution, said tank having alternating spaced-apart anodes and cathodes mounted therein forming an electrode group in each of a plurality of connecting electrode cells;

b. inlet openings formed in a side of said tank for introducing said slurry solution into each cell of said tank;

c. an overflow opening formed in a side of said tank for maintaining a slurry solution level within said tank which is above said inlet openings such that said slurry solution is introduced to said tank below said level;

d. a tank bottom including means to circulate a portion of said slurry solution from said tank bottom to the inlet openings; and e. electrical bussing in series contact with said anodes and cathodes for providing electric current to same such that when current is passed therebetween through said slurry solution, copper deposits upon said cathodes, each group of electrodes having its respective anodes and cathodes parallel-bussed on alternative opposite sides of said tank from cell to cell.

12. The apparatus of claim 11 further including manifolds on each side of the tank extending exteriorly of the tank coextensive with the plurality of cells, a cell inlet opening adjacent each of the cells for delivering slurry solution from the manifolds to the cell, said cell inlet openings being on alternative opposite sides of said tank from cell to cell.

13. The apparatus of claim 12 including an orifice plate between said manifolds and each of said cell inlet openings, said orifice plate having openings sized to introduce slurry solution at a desired velocity and flow rate and positioned to direct the slurry solution between the cathodes in a particular cell.

* * * * *